United States Patent [19]

Lembens

[11] Patent Number: 4,597,329

[45] Date of Patent: Jul. 1, 1986

[54] INKING MECHANISM FOR FRANKING AND PRICE STAMPING MACHINES

[75] Inventor: Helmut Lembens, Wiesbaden-Naurod, Fed. Rep. of Germany

[73] Assignee: Francotyp-Postalia GmbH, Berlin, Fed. Rep. of Germany

[21] Appl. No.: 778,721

[22] Filed: Sep. 18, 1985

Related U.S. Application Data

[63] Continuation of Ser. No. 608,017, May 7, 1984, abandoned.

[30] Foreign Application Priority Data

May 6, 1983 [DE] Fed. Rep. of Germany ..... 3316558

[51] Int. Cl.[4] ..... B41F 31/06

[52] U.S. Cl. ..... 101/363; 101/350

[58] Field of Search ..... 101/157, 169, 348, 349, 101/350, 351, 352, 363, 364

[56] References Cited

U.S. PATENT DOCUMENTS

| | | | |
|---|---|---|---|
| 1,028,199 | 6/1912 | Dun Lany | 101/350 X |
| 2,166,271 | 7/1939 | Storck | 101/351 |
| 2,590,538 | 3/1952 | Huck | 101/364 X |
| 2,988,989 | 6/1961 | Crawford | 101/169 X |
| 3,227,080 | 1/1966 | Hill | 101/350 X |
| 3,638,568 | 2/1972 | Granger | 101/352 X |
| 4,186,661 | 2/1980 | Vieau | 101/350 X |
| 4,414,897 | 11/1983 | Sato et al. | 101/363 X |

FOREIGN PATENT DOCUMENTS

| | | | |
|---|---|---|---|
| 2657548 | 6/1978 | Fed. Rep. of Germany | 101/363 |
| 602588 | 3/1960 | Italy | 101/350 |

*Primary Examiner*—Charles A. Pearson

*Attorney, Agent, or Firm*—Herbert L. Lerner; Laurence A. Greenberg

[57] ABSTRACT

An inking mechanism for franking or price stamping machines having a printing drum, includes a common housing having an ink storage trough formed therein, an ink application roller, an inking roller and an ink transport roller each being disposed in the common housing, a friction wheel connected to the ink application roller, the friction wheel being driven by the printing drum for driving the ink application roller, the inking roller having a cylindrical surface being contacted along the entire width thereof by the ink application roller for driving the inking roller, two friction rings connected to the ink transport roller, the ink transport roller being partially disposed in the ink storage trough and being driven by the inking roller through the friction rings, the ink transport roller accumulating a wedge-shaped ink quantity from the ink storage trough between the ink transport roller and the inking roller when the ink transport roller is rotating, and a wiper contacting the inking roller down stream of the wedge-shaped ink quantity, as seen in direction of rotation of the inking roller, for metering the ink quantity.

3 Claims, 3 Drawing Figures

INKING MECHANISM FOR FRANKING AND PRICE STAMPING MACHINES

This application is a continuation of application Ser. No. 408,017, filed May 7, 1984, now abandoned.

The invention relates to an inking mechanism for franking and price stamping machines having three rollers in a common housing, driven by the printing drum of the machine.

Inking mechanisms for franking and price stamping machines are known in the art. Systems having one to three rollers which are in use accept and apply ink onto the letter wheels, printing types and plates. For example, it is conventional to apply the ink directly to the letter wheels of a printing drum by means of a roller which contains the ink supply within a hollow space inside the roller itself. This roller is pivotably supported to prevent over-saturation of the letter wheels with ink. The contact pressure accordingly determines the intensity to which the letters on the type-wheel are inked.

It is also known to interpose an ink application roller which is covered with an absorbing material for accepting and transferring the ink from the supply contained in the other roller, in order to avoid excessive inking between the roller with the ink supply and the printing drum. However, this system also does not guarantee a uniform application of ink onto the letter wheels, printing types or plates, because the suction or absorption capability of the ink application roller is reduced by the formation of sediment and dried ink, after the device has not been used for some time.

Furthermore, inking mechanisms are known in the art in which an ink transport roller picks-up ink from an ink supply, and transfers it to an inking roller, which in turn applies the ink to an application roller. However, even a three roller system does not guarantee uniform ink application for the above-mentioned reasons, and if the pressure between the ink application roller and the printing drum is too great, the printing types, letter wheels and printing plates of postage metering machines become contaminated with dirt in a relatively short time.

It is accordingly an object of the invention to provide an inking mechanism for franking and value or price stamping machines, which overcomes the hereinaforementioned disadvantages of the heretofore-known devices of this general type, which guarantees a uniform ink supply to the ink application roller, a simple adjustment of the ink intensity, and therefore uniformly strong imprints, which can be easily assembled economically, and which can also be used as an inking mechanism for high efficiency, large volume postage metering machines, in larger sizes.

With the foregoing and other objects in view there is provided in accordance with the invention, in a franking or price stamping machine having a printing drum, the improvement comprising an inking mechanism including a common housing having an ink storage trough formed therein, an ink application roller, an inking roller and an ink transport roller each being disposed in the common housing, a friction wheel connected to the ink application roller, the friction wheel being driven by the printing drum for driving the ink application roller, the inking roller having a cylindrical surface or generatrix being contacted along the entire width thereof by the ink application roller for driving the inking roller, two friction rings connected to the ink transport roller, the ink transport roller being partially disposed in the ink storage trough and being driven by the inking roller through the friction rings, the ink transport roller accumulating a wedge-shaped ink quantity from the ink storage trough between the ink transport roller and the inking roller when the ink transport roller is rotating, and a wiper contacting the inking roller down stream of the wedge-shaped ink quantity, as seen in direction of rotation of the inking roller, for metering or dosing the ink quantity.

In accordance with another feature of the invention, there is provided a U-shaped holder clamping the wiper to the housing.

In accordance with an additional feature of the invention, there is provided an elastic L-shaped clamping connection retained in a groove formed in the housing for securing the holder to the housing.

In accordance with a concomitant feature of the invention, there is provided a supply line and a return line for supplying ink to the ink storage trough from a larger container through a pump, guaranteeing a uniform consistency of stamping ink.

Other features which are considered as characteristic for the invention are set forth in the appended claims.

Although the invention is illustrated and described herein as embodied in an inking mechanism for franking and price stamping machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
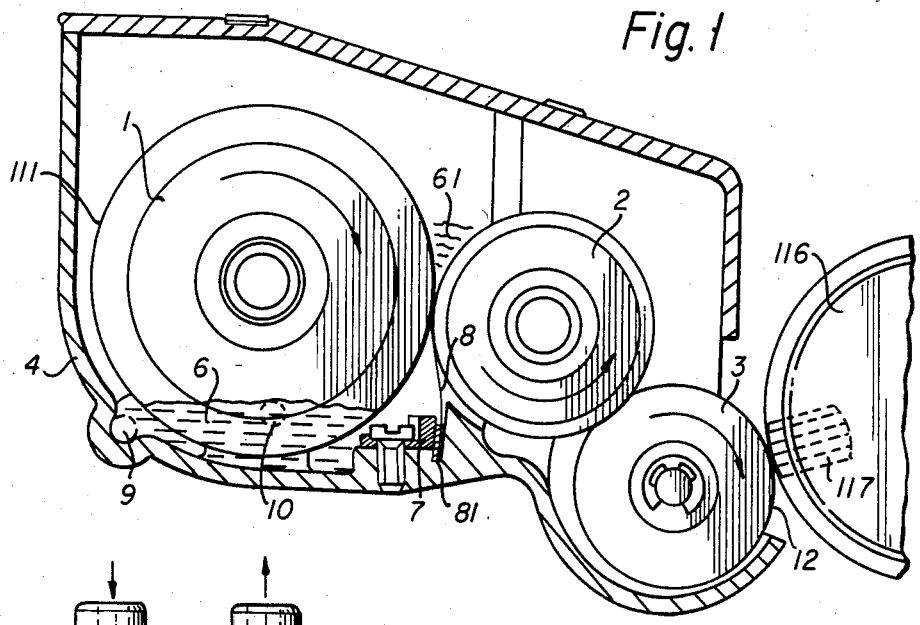
FIG. 1 is a cross-sectional view, partly broken away, of an inking mechanism.
Figure 2:
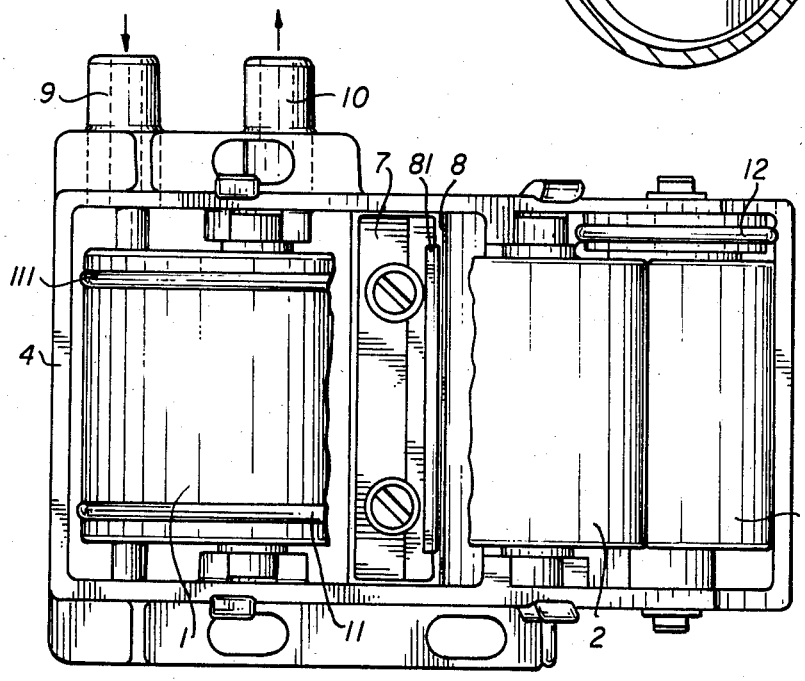
FIG. 2 is a top-plan view, partly broken away, of the inking mechanism with the cover removed.
Figure 3:
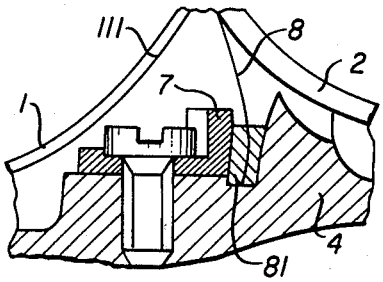
FIG. 3 is an enlarged view of the wiper assembly shown in FIG. 1.

Referring now to the figures of the drawing in detail, in which the same reference numerals are used for equivalent elements, and first particularly to FIGS. 1 and 2 thereof, it is seen that the inking mechanism includes three roller systems. An ink transport roller 1, an inking roller 2, and an ink application roller 3 are disposed in a common housing 4, in such a way that the ink application roller 3 and the inking roller 2 are in direct mutual contact over the entire width of the cylindrical generatrix or surface line thereof. The ink transport roller 1 and the inking roller 2 are engaged with each other through two friction rings 11, 111. The inking mechanism is driven by a drum 116 which moves the ink application roller 3 by means of a friction wheel 12. Gears can also be used for transmitting the rotation from the printing drum to the inking mechanism instead of friction wheels.

The contact between the ink application roller 3 and the inking roller 2 causes the inking roller to be dragged along, and to in turn move the ink transport roller 1 by means of the friction rings or wheels 11, 111. The ink transport roller runs in an ink supply trough 6 which is an integral part of the housing 4. The rotation of this roller 1 causes the ink to be transported onto the inking roller 2. This action causes an ink-wedge 61 to be formed between the ink transport roller 1 and the inking roller 2.

A wiper 8 is secured in a groove formed in the housing 4 by a clamping member, which may be in the form of an L-shaped elastic clamping device 7. The wiper 8 is a thin sheet-metal part, which is clamped in a U-shaped holder 81. The holder 81 is in turn held by the clamping device 7 in the groove formed in the housing 4, in such a position that the quantity of ink which the ink wedge 61 presents to the inking roller 2, is metered to the required ink film thickness by the position of the wiper 8. The ink film is taken up by the application roller 3 and transferred to letter wheels 117, printing type and printing plates of the printing drum 116, which contact the ink application roller 3 of the franking and price stamping machine. The stamping ink on the application roller 3 which has not been used up is again returned to the inking roller 2, so that during the next pass through the wiper 8, the placement of an ink film of uniform thickness on the application roller 3 is again guaranteed. The use of the wiper 8 avoids an excessive ink accumulation on the ink application roller 3, and accordingly also avoids smearing of the printed characters. Thus, printed reproduction of great uniformity is assured. Furthermore, the constant ink density of the ink application roller 3 makes it possible to accurately determine at what point in time the supply of ink must be replenished.

The invention offers an additional advantage if used for a large scale inking mechanism. For example, for high efficiency postage metering machines with a large volume output, an ink supply must be available which corresponds to the large number of printing impressions. For this purpose the inking mechanism is provided with two short tubes 9, 10 for feeding and returning the stamping ink.

The tubes 9, 10 are connected to an ink container of suitable size and to a suitable pump system by flexible hoses. The pump system provides a continuous ink flow, and a constant fluid level in the storage trough 6 is determined by the height of the position of the return flow tube 10. The circulation of the ink from the storage container to the ink trough 6 is independent of the operating cycle of the machine. This has the advantage of permitting the circulation of the ink to start immediately after the machine is started, and of quickly dissolving ink sediment formed while the machine is idle.

I claim:

1. In an inking mechanism for franking and price stamping machines having a printing drum, the improvement comprising a housing having an ink storage trough formed therein, a supply line and a return line connected to said ink storage trough for supplying ink to said ink storage trough, an ink application roller, an inking roller and an ink transport roller each being disposed in said housing, a friction wheel connected to said ink application roller, said friction wheel being driven by the printing drum for driving said ink application roller, said ink application roller having a cylindrical surface contacting said inking roller along the entire width of said ink application roller for driving said inking roller, two friction rings connected to said ink transport roller, said ink transport roller being partially disposed in said ink storage trough and being driven by said inking roller through said friction rings, said ink transport roller transferring ink from said ink storage trough to said inking roller at a given location, said ink transport roller accumulating a wedge-shaped ink quantity from said ink storage trough between said ink transport roller and said inking roller above said given location when said ink transport roller is rotating, a wiper having a free end contacting said inking roller below said given location for metering the ink on said inking roller, said wiper being located downstream of said wedge-shaped ink quantity, and a U-shaped holder clamping said wiper to said housing.

2. Inking mechanism according to claim 1, including an elastic L-shaped clamping connection elastically retaining said holder in a groove formed in said housing.

3. Inking mechanism according to claim 1, wherein said return line is disposed at a higher level than said supply line guaranteeing a uniform height of ink in said ink storage trough.

* * * * *